US008250867B2

(12) United States Patent
Kardos et al.

(10) Patent No.: US 8,250,867 B2
(45) Date of Patent: Aug. 28, 2012

(54) ARRANGEMENT FOR RECIRCULATION OF EXHAUST GASES IN A SUPERCHARGED COMBUSTION ENGINE

(75) Inventors: Zoltan Kardos, Södertälje (SE); Rickard Pettersson, Rönninge (SE); Tomas Alsterdal, Södertälje (SE); Henrik Nyrén, Södertälje (SE)

(73) Assignee: Scania CV AB (Publ) (SE)

( * ) Notice: Subject to any disclaimer, the term of this patent is extended or adjusted under 35 U.S.C. 154(b) by 430 days.

(21) Appl. No.: 12/514,819

(22) PCT Filed: Nov. 12, 2007

(86) PCT No.: PCT/SE2007/050836

§ 371 (c)(1),
(2), (4) Date: May 26, 2009

(87) PCT Pub. No.: WO2008/066472

PCT Pub. Date: Jun. 5, 2008

(65) Prior Publication Data

US 2009/0320467 A1 Dec. 31, 2009

(30) Foreign Application Priority Data

Nov. 27, 2006 (SE) ..... 0602517

(51) Int. Cl.
*F02B 33/00* (2006.01)
*F02B 47/08* (2006.01)

(52) U.S. Cl. ..... 60/605.2; 123/563; 123/568.12

(58) Field of Classification Search ..... 60/605.2, 60/605.1; 123/563, 568.12; *F02B 29/00*
See application file for complete search history.

(56) References Cited

U.S. PATENT DOCUMENTS

| | | | | |
|---|---|---|---|---|
| 5,598,705 | A * | 2/1997 | Uzkan | 60/599 |
| 6,367,256 | B1 | 4/2002 | McKee | |
| 6,435,166 | B1 * | 8/2002 | Sato et al. | 123/568.12 |
| 7,017,561 | B1 * | 3/2006 | Liu et al. | 123/568.12 |
| 7,076,945 | B2 * | 7/2006 | Sisken et al. | 60/295 |
| 2008/0169092 | A1 * | 7/2008 | Kardos | 165/157 |

FOREIGN PATENT DOCUMENTS

| | | | |
|---|---|---|---|
| GB | 2 421 590 | A | 6/2006 |
| WO | WO 2006088411 | A1 * | 8/2006 |

OTHER PUBLICATIONS

International Search Report dated Feb. 27, 2008, issued in corresponding international application No. PCT/SE2007/050836.

* cited by examiner

*Primary Examiner* — Quyen Leung
*Assistant Examiner* — Thomas Truong
(74) *Attorney, Agent, or Firm* — Ostrolenk Faber LLP

(57) ABSTRACT

An arrangement for recirculation of exhaust gases of a supercharged combustion engine includes a return line for recirculating exhaust gases, an air-cooled EGR cooler and a bypass line having an extent such that it can lead recirculating exhaust gases past the EGR cooler. A valve is operable to be placed in a first position to lead the whole flow of recirculating exhaust gases through the EGR cooler during situations where there is no risk of ice formation in the EGR cooler, and in a second position to lead the whole flow of recirculating exhaust gases through the bypass line during situations where there is risk of ice formation in the EGR cooler.

17 Claims, 2 Drawing Sheets

ARRANGEMENT FOR RECIRCULATION OF EXHAUST GASES IN A SUPERCHARGED COMBUSTION ENGINE

CROSS REFERENCE TO RELATED APPLICATION

The present application is a 35 U.S.C. §§371 national phase conversion of PCT/SE2007/050836, filed Nov. 12, 2007, which claims priority of Swedish Application No. 0602517-5, filed Nov. 27, 2006, the disclosure of which is incorporated by reference herein. The PCT International Application was published in the English language.

BACKGROUND TO THE INVENTION, AND STATE OF THE ART

The present invention relates to an arrangement for recirculation of exhaust gases of a supercharged combustion engine according and to controlled cooling of the recirculating exhaust gases.

The amount of air which can be supplied to a supercharged combustion engine depends on the pressure of the air but also on the temperature of the air. Supplying a largest possible amount of air to the combustion engine entails cooling the compressed air in a charge air cooler before it is led to the combustion engine. The compressed air is cooled, usually in a charge air cooler situated at a front portion of a vehicle, by surrounding air. The compressed air can thus be cooled to a temperature substantially corresponding to the temperature of the surroundings.

The technique known as EGR (Exhaust Gas Recirculation) is a known way of recirculating part of the exhaust gases from a combustion engine. The recirculating exhaust gases are mixed with the inlet air to the combustion engine before the mixture is led to the cylinders of the combustion engine. Adding exhaust gases to the air causes a lower combustion temperature resulting inter alia in a reduced content of nitrogen oxides $NO_x$ in the exhaust gases. This technique is used for both Otto engines and diesel engines. The recirculating exhaust gases are cooled, usually in an EGR cooler, before they are mixed with the inlet air. Coolant-cooled EGR coolers are commonly used, but the use of air-cooled EGR coolers is also known. In an air-cooled EGR cooler the recirculating exhaust gases are cooled to a temperature substantially corresponding to the temperature of the compressed air. The recirculating exhaust gases therefore do not warm the cooled compressed air when they are mixed and led to the combustion engine.

Exhaust gases contain a relatively large amount of water vapour. When they are cooled to a temperature below its dewpoint, the water vapour will condense within the EGR cooler. In situations where the temperature of the surrounding air is below 0° C., there is also risk of condensed water vapour freezing to ice within the EGR cooler. Such ice formation entails the possibility of the exhaust flow ducts through the EGR cooler becoming more or less obstructed, resulting in cessation of the recirculation of exhaust gases.

U.S. Pat. No. 6,367,256 refers to a combustion engine with a system for recirculation of exhaust gases, in which the recirculating exhaust gases are cooled in a coolant-cooled EGR cooler. The coolant flow through the EGR cooler is constant and large so that local boiling of the coolant in the EGR cooler is prevented even in situations where large amounts of exhaust gases are recirculated. When a smaller amount of exhaust gases is recirculated or the coolant is at a low temperature, the ample coolant flow in the EGR cooler may cool the recirculating exhaust gases to such a low temperature that the water vapour in the exhaust gases condenses. To prevent the returned exhaust gases from reaching too low a temperature, the recirculating exhaust gases are led entirely or partly through a bypass line instead of being cooled in the EGR cooler. The system comprises condensate separation devices at various points along the exhaust flow path. An object of that invention seems to be to prevent or at least reduce condensate precipitation along the exhaust flow path.

SUMMARY OF THE INVENTION

The object of the present invention is to provide an arrangement for recirculation of exhaust gases of a supercharged combustion engine whereby the exhaust gases are prevented from being cooled to below a lowest acceptable temperature in an air-cooled EGR cooler even in circumstances where the cooling air is at a very low temperature.

This object is achieved with the arrangement of the invention. An arrangement for recirculation of exhaust gases of a supercharged combustion engine includes a return line for recirculating exhaust gases, an air-cooled EGR cooler and a bypass line having an extent such that it can lead recirculating exhaust gases past the EGR cooler. A valve is operable to be placed in a first position to lead the whole flow of recirculating exhaust gases through the EGR cooler during situations where there is no risk of ice formation in the EGR cooler, and in a second position to lead the whole flow of recirculating exhaust gases through the bypass line during situations where there is risk of ice formation in the EGR cooler. According to the invention, the arrangement thus comprises a bypass line and a valve means by which it is possible to lead the exhaust gases past the EGR cooler if there is risk of their being cooled to below a lowest acceptable temperature in the EGR cooler. In circumstances where there is risk of the recirculating exhaust gases being cooled to below the lowest acceptable temperature in the EGR cooler, the valve means is therefore placed in the second position so that the whole exhaust flow is led past the EGR cooler. The recirculating exhaust gases are thus prevented from being cooled to below the lowest acceptable temperature. Exhaust gases contain water vapor. When they are cooled to a temperature below the dewpoint of the water vapor, water in liquid form will precipitate within the EGR cooler. If the exhaust gases are cooled to a temperature below 0° C., the precipitated water will freeze to ice within the EGR cooler. The aforesaid lowest acceptable temperature refers primarily to the gaseous medium not being cooled to a temperature below 0° C. which would result in ice forming within the cooler. In practice, however, a safety margin of a couple of degrees may be applicable for ensuring that ice formation will not occur in any part of the EGR cooler. The possibility is nevertheless not excluded that said lowest acceptable temperature may refer to other temperatures and other phenomena than ice formation, e.g. it may be desirable to prevent too much condensation of water vapor within the EGR cooler.

In circumstances where there is risk of the recirculating exhaust gases being cooled to below the lowest acceptable temperature in the EGR cooler, the valve means is therefore placed in the second position that the whole exhaust flow is led past the EGR cooler. The recirculating exhaust gases are thus prevented from being cooled to below the lowest acceptable temperature. Exhaust gases contain water vapour. When they are cooled to a temperature below the dewpoint of the water vapour, water in liquid form will precipitate within the EGR cooler. If the exhaust gases are cooled to a temperature below 0° C., the precipitated water will freeze to ice within the EGR cooler. The aforesaid lowest acceptable temperature refers primarily to the gaseous medium not being cooled to a temperature below 0° C. which would result in ice forming within the cooler. In practice, however, a safety margin of a couple of degrees may be applicable for ensuring that ice formation will not occur in any part of the EGR cooler. The possibility is nevertheless not excluded that said lowest acceptable temperature may refer to other temperatures and other phenomena than ice formation, e.g. it may be desirable to prevent too much condensation of water vapour within the EGR cooler.

According to an embodiment of the present invention, the arrangement comprises a manually settable control device by which it is possible to place the valve means in said first position or said second position. Such a control device enables a driver to take a decision and determine in which position the valve means should be placed and when it should be changed. The driver can make such a decision on the basis, for example, of knowing the temperature of the surrounding air and the prevailing weather conditions. With advantage, however, the arrangement comprises a control unit adapted to receiving information concerning at least one parameter for deciding whether there is risk of ice formation in the EGR cooler and to placing the valve means in the second position when it decides there is such a risk. Thus the control unit can automatically place the valve means in an appropriate position during operation of the combustion engine. The control unit may be a computer unit provided with software adapted to deciding in which position to place the valve means on the basis of information about one or more guiding parameters. Preferably, the arrangement comprises a temperature sensor adapted to detecting the temperature of the surrounding air and the control unit is adapted to using information from said temperature sensor to decide whether there is risk of ice formation in the EGR cooler. By a simple control process, the control unit will place the valve means in the first position when the temperature sensor indicates a temperature above 0° C. and in the second position when the temperature sensor indicates a temperature below 0° C. The control process may nevertheless be significantly more complex. With a more complex control process, it is possible to detect situations where it is appropriate to use the air-cooled EGR cooler even if the surrounding air is at a temperature below 0° C.

According to a preferred embodiment of the invention, the control unit may be adapted to using knowledge of a parameter which is related to the exhaust flow through the return line to decide whether there is risk of ice formation in the EGR cooler. When a larger exhaust flow is led through the EGR cooler, the exhaust gases cannot be cooled to as low a temperature as when a smaller exhaust flow is led through the it. In situations where an ambient temperature somewhat below 0° C. prevails, the control unit can therefore place the valve means in the first position when large amounts of exhaust gases are returned via the return line and place the valve means in the second position when smaller amounts of exhaust gases are returned via the return line. The control unit may also be adapted to using knowledge of a parameter which is related to the flow velocity of the surrounding air through the EGR cooler to decide whether there is risk of ice formation in the EGR cooler. The flow velocity of the surrounding air is a parameter which determines how effectively the recirculating exhaust gases are cooled in the EGR cooler. If the cooling air flows at a high velocity through the EGR cooler, the result is more effective cooling of the recirculating exhaust gases than when the air is at a lower velocity.

According to a preferred embodiment of the invention, the arrangement comprises a coolant-cooled EGR cooler adapted to cooling the recirculating exhaust gases in a first stage before they are cooled in the air-cooled EGR cooler in a second stage. Assurance is thus afforded that the exhaust gases will undergo acceptable cooling in all circumstances. With advantage, the coolant of the cooling system for the combustion engine is used for cooling the recirculating exhaust gases in the first stage. The recirculating exhaust gases can thus be provided with effective cooling in the first stage. The EGR cooler may comprise a first tank for receiving recirculating exhaust gases, a cooling portion through which the recirculating exhaust gases flow during cooling by surrounding air, and a second tank for receiving the recirculating exhaust gases after they have been cooled in the cooling portion. Such an EGR cooler may with advantage be fitted at a front portion of a vehicle where it has air at the temperature of the surroundings flowing through it. The valve means may be arranged in the first tank and said bypass line may extend between the first tank and the second tank, making it possible for the bypass to constitute an integral part of the EGR cooler and be fitted together with it as a composite unit.

BRIEF DESCRIPTION OF THE DRAWINGS

Preferred embodiments of the invention are described below by way of examples with reference to the attached drawings, in which.

DETAILED DESCRIPTION OF PREFERRED EMBODIMENTS OF THE INVENTION

Figure 1:
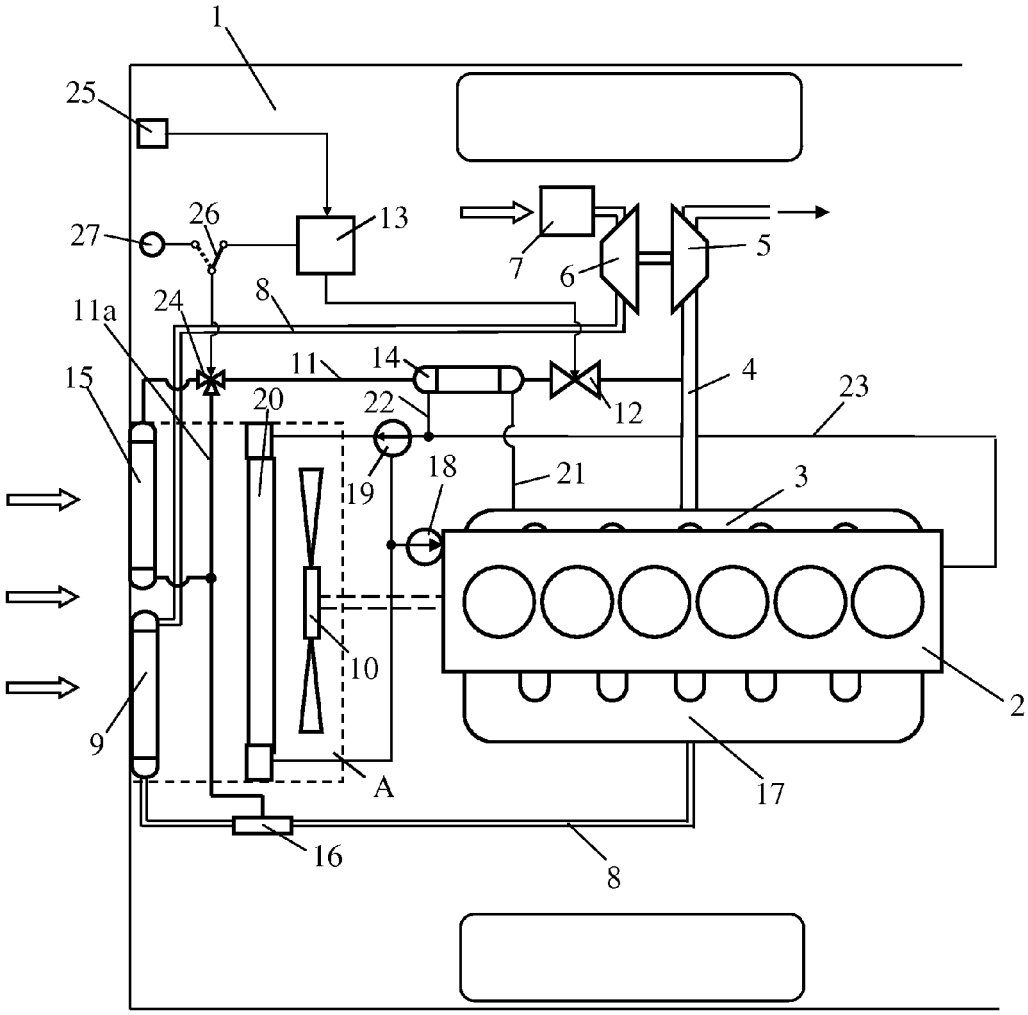
FIG. 1 depicts an arrangement according to a first embodiment of the invention and FIG. 2 depicts an arrangement according to a second embodiment of the invention.

FIG. 1 depicts a vehicle 1 powered by a supercharged combustion engine 2. The vehicle 1 may be a heavy vehicle powered by a supercharged diesel engine. The exhaust gases from the cylinders of the combustion engine 2 are led via an exhaust manifold 3 to an exhaust line 4. The exhaust gases in the exhaust line 4, which are at above atmospheric pressure, are led to a turbine 5 of a turbo unit. The turbine 5 is thus provided with driving power which is transferred, via a connection, to a compressor 6. The compressor 6 compresses air which is led into an inlet line 8 via an air filter 7. A charge air cooler 9 is arranged in the inlet line 8. The charge air cooler 9 is arranged in a region A at a front portion of the vehicle 1. The function of the charge air cooler 9 is to cool the compressed air before it is led to the combustion engine 2. The compressed air is cooled in the charge air cooler 9 by surrounding air which is caused to flow through the charge air cooler 9 by a radiator fan 10 and the draught caused by forward movement of the vehicle 1. The radiator fan 10 is driven by the combustion engine 2 via a suitable connection.

The combustion engine 2 is provided with an EGR (Exhaust Gas Recirculation) system for recirculation of exhaust gases. Adding exhaust gases to the compressed air led to the engine's cylinders lowers the combustion temperature and hence also the content of nitrogen oxides ($NO_x$) formed during the combustion processes. A return line 11 for recirculation of exhaust gases extends from the exhaust line 4 to the inlet line 8. The return line 11 comprises an EGR valve 12 by which the exhaust flow in the return line 11 can be shut off. The EGR valve 12 may also be used for steplessly controlling the amount of exhaust gases led from the exhaust line 4 to the inlet line 8 via the return line 11. A control unit 13 is adapted to controlling the EGR valve 12 on the basis of information about the operating state of the combustion engine 2. The return line 11 comprises a first EGR cooler 14 for subjecting the exhaust gases to a first stage of cooling, and a second EGR cooler 15 for subjecting the exhaust gases to a second stage of cooling. In supercharged diesel engines 2, in certain operating situations, the pressure of the exhaust gases in the exhaust line 4 will be lower than the pressure of the compressed air in the inlet line 8. In such situations it is not possible to mix the exhaust gases in the return line 11 directly with the compressed air in the inlet line 8 without special auxiliary means. To this end it is possible to use, for example, a venturi 16. If instead the combustion engine 2 is a supercharged Otto engine, the exhaust gases in the return line 11 can be led directly into the inlet line 8, since the exhaust gases in the exhaust line 4 of an Otto engine in substantially all operating situations will be at a higher pressure than the compressed air in the inlet line 8. When the exhaust gases have mixed with the compressed air in the inlet line 8, the mixture is led via a manifold 17 to the respective cylinders of the combustion engine 2.

The combustion engine 2 is cooled in a conventional manner by a cooling system which contains a circulating coolant. The coolant is circulated in the cooling system by a coolant pump 18. The cooling system also comprises a thermostat 19 adapted to leading the coolant to a radiator 20 when the coolant has reached a temperature at which it needs cooling. The radiator 20 is fitted at a forward portion of the vehicle 1 at a location downstream from the charge air cooler 9 and the second EGR cooler 15 with respect to the intended direction of air flow in the region A. The coolant in the cooling system is also used for subjecting the recirculating exhaust gases to the first stage of cooling in the first EGR cooler 14. To this end, the cooling system comprises a manifold in the form of a line 21 which initially leads coolant to the first EGR cooler 14 for the first stage of cooling the recirculating exhaust gases. The first EGR cooler 14 may be fitted on or close to the combustion engine 2. The recirculating exhaust gases may here be cooled from a temperature of about 500-600° C. to a temperature in the vicinity of the temperature of the coolant, which is usually within the range 70-90° C. When the coolant has passed through the first EGR cooler 14, it is led via a line 22 to a line 23 in which it is mixed with warm coolant from the combustion engine 2. The coolant is led via the line 23 to the radiator 20, in which it is cooled before being used again for cooling the combustion engine 2 or the recirculating exhaust gases in the first EGR cooler 14. The compressed air in the charge air cooler 9 and the recirculating exhaust gases in the second EGR cooler 15, which is fitted at a front surface of the vehicle 1, have air at the temperature of the surroundings flowing through them. It is thus possible to cool the compressed air and the exhaust gases to a temperature substantially corresponding to the temperature of the surroundings. The air and the exhaust gases are cooled so that they occupy a smaller specific volume. Cooling the compressed air and the exhaust gases to a temperature substantially corresponding to the temperature of the surroundings makes it possible for a substantially optimum amount of air and recirculating exhaust gases to be led into the cylinders of the combustion engine.

When the temperature of the surroundings is low, there is risk of the exhaust gases being cooled to a temperature such that water vapour in the exhaust gases condenses within the second EGR cooler 15. If the temperature of the surroundings is also below 0° C., condensed water vapour may freeze to ice within the second EGR cooler 15. The exhaust flow ducts in the second EGR cooler 15 may thus become obstructed. The exhaust gases should therefore not be cooled to a temperature below 0° C. To prevent such cooling of the recirculating exhaust gases, the return line 11 is provided with a bypass line 11*a*. The extent of the bypass line 11*a* is such that it can lead recirculating exhaust gases past the EGR cooler 15. The return line 11 also comprises a valve means in the form of a three-way valve 24 which can be placed in a first position to lead the whole flow of recirculating exhaust gases in the return line 11 through the second EGR cooler 15 and in a second position to lead the whole flow of recirculating exhaust gases in the return line 11 through the bypass line 11*a*. The control unit 13 is adapted to controlling the three-way valve 24 on the basis of information from a temperature sensor 25 which is so positioned as to detect the temperature of the surrounding air. If a driver of the vehicle 1 wishes to disconnect the automatic control applied to the three-way valve 24 by the control unit 13, a connecting means 26 can be placed in a position for manual control of the three-way valve 24. Such manual control may be initiated by means of a control device in the form of, for example, a button means 27 situated at an appropriate location in the vehicle's driving cab.

During operation of the combustion engine 2, the control unit 13 thus receives information from the temperature sensor 25 concerning the temperature of the surrounding air. So long as the temperature of the surrounding air is above 0° C., there is no risk of ice formation in the second EGR cooler 15. In this situation, the control unit 13 has the three-way valve 24 placed in the first position and the recirculating exhaust gases undergo both a first stage of cooling in the first EGR cooler and a second stage of cooling in the second EGR cooler 15. The recirculating exhaust gases can thus be cooled to substantially the same temperature as the compressed air in the charge air cooler 9. If the temperature of the surrounding air is below 0° C. the control unit 13 needs to take further parameters into account to enable it to determine whether recirculating exhaust gases can be led through the second EGR cooler 15 without risk of the exhaust gases being cooled to a temperature below 0° C. Such a parameter may be the amount of exhaust gases returned via the return line 11. A larger amount of exhaust gases led through the EGR cooler 15 will not be cooled to as low a temperature as a smaller amount of exhaust gases. In situations where the ambient temperature is below 0° C., the control unit 13 can place the three-way valve 24 in the first position whereby larger amounts of exhaust gases are returned via the return line 11 and place the three-way valve 24 in the second position whereby smaller amounts of exhaust gases are returned via the return line 11. A further parameter which the control unit 13 may take into account is the flow velocity of the surrounding air through the EGR cooler 15. The surrounding air provides more effective cooling of the recirculating exhaust gases when it flows through the EGR cooler 15 at a high velocity than at lower velocities. The flow velocity of the air depends on the speed of the radiator fan 10, which is normally related to the speed of the combustion engine 2 and the speed of the vehicle. On the basis of one or more of the abovementioned parameters, the control unit 13 can place the three-way valve 24 in the first position in certain operating and ambient situations even if the surrounding air is at a temperature below 0° C. In other situations where the surrounding air is at a temperature below 0° C., the control unit 13 will place the three-way valve 24 in the second position so that the recirculating exhaust gases are led past the second EGR cooler 15. Since the recirculating exhaust gases will have already been cooled in a first EGR cooler 14 by the coolant which cools the combustion engine, they will in most circumstances have already undergone relative good but not optimum cooling.

Figure 2:
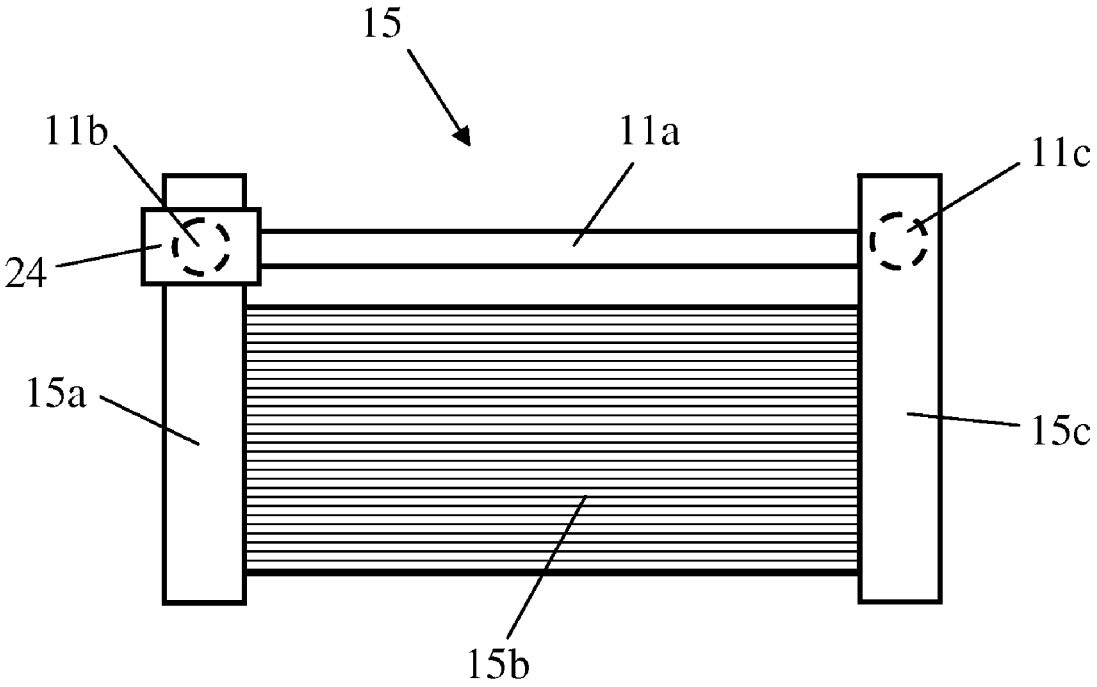

FIG. 2 depicts a second air-cooled EGR cooler 15 in more detail. The EGR cooler 15 comprises a first tank 15*a* for receiving recirculating exhaust gases from the return line 11 via an inlet aperture 11*b*. The EGR cooler 15 further comprises a cooling portion 15*b* in which the recirculating exhaust gases are cooled by surrounding air. The cooling portion 15*b* comprises in a conventional manner a plurality of substantially parallel tubes for guiding the recirculating exhaust gases. The cooling surrounding air is adapted to flowing through the cooling portion 15*b* in ducts existing between the tubes. The EGR cooler 15 also comprises a second tank 15*c* for receiving the recirculating exhaust gases after they have been cooled in the cooling portion 15*b*. The recirculating exhaust gases leave the second tank 15*c* via an outlet aperture 11*c* which is connected to the return line 11. A three-way valve 24 is arranged in the first tank 15*a* close to the inlet aperture 11*b*. The three-way valve 24 is arranged close to a bypass line 11*a* which extends between the first tank 15*a* and the second tank 15*b*. The three-step valve 24 and the bypass line 11*a* may here constitute integral parts of the EGR cooler 15. The EGR cooler 15, the three-step valve 24 and the bypass line 11*a* may therefore be fitted in a vehicle as a composite unit.

When there is no risk of ice formation, the three-way valve 24 is placed in the first position, leading the recirculating exhaust gases in the return line 11 into the first tank 15*a*. From the first tank 15*a*, the recirculating exhaust gases are led to the cooling portion, in which they are cooled by surrounding air. The cooled recirculating exhaust gases leave the EGR cooler 15 via the second tank 15*c*. In this situation, the recirculating exhaust gases undergo cooling in two stages to a temperature substantially corresponding to the temperature of the surrounding air. When there is risk of ice formation, the three-way valve 24 is placed in the second position. It leads the recirculating exhaust gases substantially directly from the inlet aperture 11*b* to the bypass line 11*a*. The exhaust gases flow through the bypass line 11*a* to a location in the second tank 15*c* close to the outlet aperture 11*c*. In this case the exhaust gases are thus led past the cooling portion 15*b* of the EGR cooler. The bypass line 11*a* may here have an extent within the region A which thus has air at the temperature of the surroundings flowing through it. The recirculating exhaust gases may thus undergo a certain cooling when they are led through the bypass line 11*a*. To eliminate the risk of ice formation in the EGR cooler 15, cooling of the recirculating exhaust gases is therefore here effected only in the coolant-cooled EGR cooler 14. Cooling the recirculating exhaust gases in the coolant-cooled EGR cooler only is not optimum but is nevertheless often perfectly acceptable. The second stage of cooling is thus only excluded in situations where the control unit 13 decides that there is an obvious risk of ice formation. In particular, situations where surrounding air is at a temperature just below 0° C. may be relatively brief when, for example, periods of abundant recirculation of exhaust gases can be avoided.

The invention is in no way limited to the embodiments described but may be varied freely within the scopes of the claims.

The invention claimed is:

1. An arrangement for recirculation of exhaust gases of a supercharged combustion engine, the arrangement comprising:

an exhaust line operable to lead exhaust gases out from the combustion engine;

an inlet line operable to lead air to the combustion engine;

a return line connected to the exhaust line and to the inlet line for enabling the return line to recirculate exhaust gases from the exhaust line to the inlet line;

an air-cooled EGR cooler configured and operable to cool the recirculating exhaust gases by air as a primary cooling medium, the air being at a temperature of the surroundings;

the return line including:

a liquid coolant-cooled EGR cooler configured and operable to cool the recirculating exhaust gases in a first stage before the exhaust gases are cooled in the air-cooled EGR cooler in a second stage, a bypass line having an extent positioned and configured to lead the recirculating exhaust gases to the inlet line so as to bypass the EGR cooler, and a valve positioned between the EGR cooler and the liquid coolant-cooled EGR cooler and configured and operable to be positioned in one of two valve positions, the two valve positions comprising a first valve position which leads the entire flow of recirculating exhaust gases in the return line through the EGR cooler and a second valve position which leads the entire flow of recirculating exhaust gases in the return line through the bypass line, and the valve being further configured and operable to be positioned to the first valve position when there is no risk of ice formation in the EGR cooler and to the second valve position when there is risk of ice formation in the EGR cooler.

2. An arrangement according to claim 1, further comprising a manually operable control device operable to selectively place the valve in the first position or the second position.

3. An arrangement according to claim 1, further comprising a control unit configured and operable to receive information concerning at least one parameter for determining a risk of ice formation in the EGR cooler, and configured and operable to place the valve in the second position when the control unit determines there is such a risk.

4. An arrangement according to claim 3, further comprising a temperature sensor configured and operable to detect a temperature of the surrounding air, and the control unit is configured and operable to use information from the temperature sensor to decide the risk of ice formation in the EGR cooler.

5. An arrangement according to claim 4, wherein the control unit is configured and operable to use knowledge of a parameter is related to the flow velocity of the surrounding air through the EGR cooler.

6. An arrangement according to claim 3, wherein the control unit is configured and operable to use knowledge of a parameter related to the exhaust flow through the return line to decide the risk of ice formation in the EGR cooler.

7. An arrangement according to claim 3, wherein the control unit is configured and operable to use knowledge of a parameter related to the flow velocity of the surrounding air through the EGR cooler.

8. An arrangement according to claim 3, wherein the control unit is configured and operable to place the valve in the first position when the control unit determines no risk of ice formation in the EGR cooler.

9. An arrangement according to claim 1, further comprising a coolant-cooled EGR cooler configured and operable to cool the recirculating exhaust gases in a first stage before the exhaust gases are cooled in the air-cooled EGR cooler in a second stage.

10. An arrangement according to claim 9, wherein the coolant cooled EGR cooler is in the return line.

11. An arrangement according to claim 1, wherein the EGR cooler comprises:

a first tank configured to receive the recirculating exhaust gases, a cooling portion connected with the first tank through which the recirculating exhaust gases flow and the cooling portion being positioned for enabling cooling of recirculating exhaust gas flow in the cooling portion during cooling by surrounding air, and a second tank connected with the cooling portion configured to receive the recirculating exhaust gases after cooling in the cooling portion.

12. An arrangement according to claim 11, wherein the valve is arranged in the first tank and the bypass line extends between the first tank and the second tank.

13. An arrangement according to claim 12, wherein the bypass line is an integral part of the EGR cooler.

14. The arrangement according to claim 1, wherein the liquid coolant-cooled EGR cooler is configured to be cooled by the liquid coolant for cooling the supercharged combustion engine.

15. An arrangement for recirculation of exhaust gases of a supercharged combustion engine, the arrangement comprising:

an exhaust line configured to lead exhaust gases out from the combustion engine;

an inlet line configured to lead air to the combustion engine;

a return line connected to the exhaust line and to the inlet line such that the return line is positioned and configured to recirculate exhaust gases from the exhaust line to the inlet line;

an air-cooled EGR cooler configured to cool the recirculating exhaust gases by air as a primary cooling medium;

the return line including:

a liquid coolant-cooled EGR cooler configured to cool the recirculating exhaust gases in a first stage before the exhaust gases are cooled in the air-cooled EGR cooler in a second stage, a bypass line having an extent positioned and configured to lead the recirculating exhaust gases to the inlet line so as to bypass the EGR cooler, and a valve positioned between the EGR cooler and the liquid coolant-cooled EGR cooler, the valve configured to be positioned in one of two valve positions, the two valve positions comprising a first valve position configured to lead the flow of recirculating exhaust gases in the return line through the EGR cooler and a second valve position configured to lead the flow of recirculating exhaust gases in the return line through the bypass line, and the valve being further configured to be positioned to the first valve position when there is no risk of ice formation in the EGR cooler and to the second valve position when there is risk of ice formation in the EGR cooler.

16. An arrangement for recirculation of exhaust gases of a supercharged combustion engine, the arrangement comprising:

an exhaust line configured to lead exhaust gases out from the combustion engine;

an inlet line configured to lead air to the combustion engine;

a return line connected to the exhaust line and to the inlet line such that the return line is positioned and configured to recirculate exhaust gases from the exhaust line to the inlet line;

an air-cooled EGR cooler configured to cool the recirculating exhaust gases by air as a primary cooling medium, the air being at a temperature of the surroundings;

the return line including:

a bypass line positioned and configured to lead the recirculating exhaust gases to the inlet line so as to bypass the EGR cooler, and a valve configured to be positioned in one of two valve positions, the two valve positions comprising a first valve position which leads the flow of recirculating exhaust gases in the return line through the EGR cooler and a second valve position which leads the flow of recirculating exhaust gases in the return line through the bypass line, and the valve being further configured to be positioned to the first valve position when there is no risk of ice formation in the EGR cooler and to the second valve position when there is risk of ice formation in the EGR cooler, wherein the EGR cooler comprises:

a first tank configured to receive the recirculating exhaust gases, a cooling portion connected with the first tank through which the recirculating exhaust gases flow and the cooling portion being positioned for enabling cooling of recirculating exhaust gas flow in the cooling portion during cooling by surrounding air, and a second tank connected with the cooling portion configured to receive the recirculating exhaust gases after cooling in the cooling portion, wherein the valve is arranged in the first tank, and the bypass line extends between the first tank and the second tank.

17. The arrangement according to claim 16, wherein the bypass line is an integral part of the EGR cooler.

* * * * *